US011873614B2

(12) United States Patent
Holl

(10) Patent No.: US 11,873,614 B2
(45) Date of Patent: Jan. 16, 2024

(54) FRAME SYSTEM AND MANHOLE COVERING

(71) Applicant: ACO Severin Ahlmann GmbH & Co. Kommanditgesellschaft, Büdelsdorf (DE)

(72) Inventor: Sebastian Holl, Roth (DE)

(73) Assignee: ACO AHLMANN SE & CO. KG, Budelsdorf (DE)

( * ) Notice: Subject to any disclaimer, the term of this patent is extended or adjusted under 35 U.S.C. 154(b) by 493 days.

(21) Appl. No.: 17/269,601

(22) PCT Filed: Aug. 21, 2019

(86) PCT No.: PCT/EP2019/072340
§ 371 (c)(1),
(2) Date: Feb. 19, 2021

(87) PCT Pub. No.: WO2020/038982
PCT Pub. Date: Feb. 27, 2020

(65) Prior Publication Data

US 2021/0198862 A1 Jul. 1, 2021

(30) Foreign Application Priority Data

Aug. 23, 2018 (DE) ..... 10 2018 120 623.2

(51) Int. Cl.
*E02D 29/14* (2006.01)

(52) U.S. Cl.
CPC ..... *E02D 29/1454* (2013.01)

(58) Field of Classification Search
CPC ... E02D 29/1454; E02D 29/14; E02D 29/149; E03F 2005/028
See application file for complete search history.

(56) References Cited

U.S. PATENT DOCUMENTS 1,719,151 A * 7/1929 Wathey ..... E02D 29/1418 49/389
1,820,127 A * 8/1931 Elkington ..... E02D 29/14 49/213

(Continued)

FOREIGN PATENT DOCUMENTS

CA 1291782 C * 11/1991 ..... B29C 65/542
CN 205421338 U 8/2016

(Continued)

OTHER PUBLICATIONS

An Office Action issued in corresponding application, 201980055389.0; dated: Apr. 13, 2022.

(Continued)

*Primary Examiner* — Theodore V Adamos
(74) *Attorney, Agent, or Firm* — Pearne & Gordon LLP

(57) ABSTRACT

A frame system for a manhole covering includes at least one first frame element and one second frame element, each including at least one first connecting surface and/or at least one second connecting surface. The first and second frame elements are connectable to one another in a friction-locked and/or formfitting manner along the opposing first or second connecting surfaces, wherein in the connected state of the first and second frame element at least one joining region is formed between the opposing first connecting surfaces or between the opposing second connecting surfaces. The joining region can be filled using a joining element in such a way that the joined connection of the frame elements is detachable and reproducible wherein the joining element comprises a hot melt adhesive.

10 Claims, 4 Drawing Sheets

(56) References Cited

U.S. PATENT DOCUMENTS

| | | | | | |
|---|---|---|---|---|---|
| 2,109,287 | A * | 2/1938 | Elkington | E02D 29/14 | 404/25 |
| 2,877,696 | A * | 3/1959 | Elkington | E02D 29/14 | 404/25 |
| 4,121,390 | A | 10/1978 | Hall et al. | | |
| 4,123,034 | A * | 10/1978 | Crunk | E02D 29/14 | 249/165 |
| 4,637,752 | A * | 1/1987 | Centa | E02D 29/14 | 404/25 |
| 4,867,600 | A * | 9/1989 | Bowman | E02D 29/124 | 404/26 |
| 4,927,290 | A * | 5/1990 | Bowman | E02D 29/14 | 404/26 |
| 2007/0039248 | A1 | 2/2007 | Rhodes | | |
| 2007/0237580 | A1 | 10/2007 | Sulak et al. | | |
| 2007/0272341 | A1* | 11/2007 | Khan | E04D 13/1407 | 52/60 |
| 2015/0375478 | A1 | 12/2015 | Gruhn et al. | | |

FOREIGN PATENT DOCUMENTS

| | | | | |
|---|---|---|---|---|
| CN | 107724676 | A | 2/2018 | |
| DE | 7701915 | U1 | 9/1977 | |
| DE | 3313130 | A1 | 10/1984 | |
| DE | 8601476 | U1 | 4/1986 | |
| DE | 8601476 | U1 | 5/1986 | |
| EP | 0036079 | A1 * | 9/1981 | |
| EP | 0300829 | A1 | 1/1989 | |
| EP | 0481938 | A2 * | 4/1992 | |
| EP | 0481938 | A2 | 4/1992 | |
| EP | 1111138 | A2 | 6/2001 | |
| EP | 1632611 | A2 | 3/2006 | |
| EP | 2325399 | A1 | 5/2011 | |
| EP | 2 759 580 | A1 | 7/2014 | |
| FR | 2472632 | A1 * | 7/1981 | |
| GB | 318012 | A | 9/1929 | |
| GB | 2084684 | A * | 4/1982 | B22D 19/04 |
| GB | 2455788 | A * | 6/2009 | E02D 29/12 |
| GB | 2543597 | A | 4/2017 | |
| WO | 95/21967 | A1 | 8/1995 | |
| WO | 01/42576 | A1 | 6/2001 | |
| WO | 2012135914 | A1 | 10/2012 | |

OTHER PUBLICATIONS

An Office Action issued in corresponding application, 19 759 526.7; dated: Apr. 4, 2022.

The Examination Report issued in corresponding Australian Patent Application No. 2019326745; dated: Mar. 10, 2022.

The an Office Action issued in corresponding Chinese Patent Application 201980055389.0 ; dated: Dec. 10, 2021.

* cited by examiner

FRAME SYSTEM AND MANHOLE COVERING

The invention relates to a frame system for a manhole covering having at least one first and one second frame element. Furthermore, the invention relates to a manhole covering.

In manhole coverings, a joint or a gap is necessary for the assembly between the individual frame parts due to different tolerances of the cover and the frame parts. To be able to compensate for these tolerances and be able to provide a stable device at the same time, the joints are typically caulked using lead. The frame parts and the cover of a manhole covering can thus be exactly finished.

Using lead for caulking the joint requires, in particular in the case of processing hot liquid lead, special work safety measures during the installation and a possible removal of the manhole covering.

In addition, lead has been classified in the meantime as a material toxic to reproduction. Tightening of work safety guidelines and incorporating lead into the list for particularly concerning materials can follow on this basis. Accordingly, a restriction of the use of lead is to be expected in future, whereby a substitution of the material will become necessary.

The invention is based on the object of providing a frame system, in particular for a manhole covering, which is simple, cost-effective, and safe to produce, enables simplified assembly on location, is reusable, provides a compensation of tolerances for exact formation, and is resistant to weather and wear. Furthermore, it is the object of the invention to specify a manhole covering.

According to the invention, this object is achieved with respect to the frame system by the subject matter of claim 1 and with respect to the manhole covering by the subject matter of claim 5. Preferred embodiments are specified in the dependent claims.

Specifically, the object is achieved by a frame system for a manhole covering, having at least one first and one second frame element, which each include at least one first connecting surface and/or at least one second connecting surface. The first and second frame element are connectable to one another in a friction-locked and/or formfitting manner along the opposing first and second connecting surfaces. In the connected state of the first and second frame element, at least one joining region is formed between the opposing first connecting surfaces or between the opposing second connecting surfaces, wherein the joining region can be filled with a joining element in such a way that the joined connection of the frame elements is detachable and reproducible. In particular, the joining region can expediently be filled or filled up in the connected state of the first and frame element using the joining element, in particular a hot melt adhesive.

The invention is based on the concept that a joint or a gap between frame elements connectable to one another can be formed and filled up using an expedient joining element in such a way that tolerances of the components of the frame element or an associated manhole covering can be compensated for.

Furthermore, the connected frame elements are to be able to be disassembled nondestructively after filling the joint with the joining element so that a disassembly to transport the frame system and a renewed assembly at the usage location is possible. An advantageous production and a simplified transport to the usage location of the frame system or the manhole covering can thus be provided.

In particular, it is provided according to the invention that at least one joining region is formed between the opposing first connecting surfaces or between the opposing second connecting surfaces, wherein the joining region, preferably exclusively the joining region, between the first and second frame element can be filled with a joining element in such a way that the joined connection of the frame elements is detachable and reproducible.

Each frame element includes a first connecting surface and a second connecting surface. The first connecting surface is to be understood in the meaning of the present invention in particular as a corner connecting surface, i.e., a connecting surface in a corner region of the frame system. The second connecting surface is preferably to be understood as a lateral connecting surface, i.e., a connecting surface along a lateral extension of the frame system. The first and second connecting surfaces, i.e., the corner connecting surfaces and the lateral connecting surfaces, can have geometries which are identical to or different from one another.

According to a first embodiment of the invention, a frame element according to the invention can include exclusively corner connecting surfaces, i.e., first connecting surfaces, or exclusively lateral connecting surfaces, i.e., second connecting surfaces. In addition, the frame element according to the invention can, according to a second embodiment of the invention, include both corner and also lateral connections having respective corner connecting surfaces and lateral connecting surfaces.

The joining region between two opposing connecting surfaces of two frame elements can be filled up by means of the joining element. In particular when the frame elements are expediently connected to one another and form a joining region, the joining element can expediently be introduced or poured into the joining region. In the meaning of the invention, the frame elements arranged adjacent can thus be joined along their connecting surfaces oriented opposite to one another.

Both the friction-locked and/or formfitting connection of the frame elements and also the joining by means of the joining element are detachable and reproducible. Accordingly, the joined connection can be disassembled nondestructively and can be completely reproduced in an expedient and functional manner. The joining element is provided in such a way that the function of the joined connection between the frame elements can be provided again in its entirety after renewed assembly.

It is thus possible that the frame element is completely assembled in the course of the production and the joining element is expediently introduced, the frame element is subsequently disassembled, transported to the usage location, and completely assembled once again on location. Simplified production and optimized transport and usage of the frame system according to the invention are thus ensured.

According to one embodiment, the joining region can be caulked by means of the joining element, so that the joining element can be introduced into the joining region in the connected state of the first and second frame element.

The joining element can be introduced as a fluid into the joining region, so that the fluid joining element can expediently fill up, in particular completely, the joint formed between the first and second frame element. Small joining regions and varying cross-sections ofjoining regions can thus also expediently be filled up. Preferably, exclusively the joining region between the frame elements connected to one another is filled up using the joining element.

The joining element can change its physical state to a solid body after a curing procedure or curing process within the joining region. In particular, the joining element can change its physical state in the course of a temperature change, so that the joining element assumes a solid physical state in the case of decreasing temperature. The joining element preferably has a melting temperature such that processing of the joining element is facilitated.

According to one embodiment, the joining element includes a hot melt adhesive. In this meaning, the joining element can be converted to a fluid or flowing physical state by a temperature increase and can be poured or introduced into the at least one joining region of the frame system.

In particular, the hot melt adhesive can have commercially typical processing parameters in this case, so that simple processing is possible without special safety precautions, as are necessary, for example during the processing of liquid lead. Lead as a joining material can thus be replaced adequately by the hot melt adhesive.

Furthermore, nondestructive disassembly and reproduction of the connection joined by means of hot melt adhesive is possible after the initial joining.

According to a further embodiment, the hot melt adhesive includes a co-polyamide. The at least one joint of the frame system can thus be filled using commercially typical materials. Furthermore, a durable and weather-resistant joint having adequate mechanical properties, comparable to joining using lead, is available.

In one preferred embodiment, the frame system includes at least four frame elements each having first and/or second connecting surface, wherein in each case at least one joining region is formed along the first or second connecting surfaces opposing one another between adjoining frame elements, wherein in the connected state of the frame elements, in particular to form the frame system, only the joining regions each can be or are filled using the joining element.

By exclusively filling the joining region using the joining element, a material savings and a shortened production time for the frame system can be achieved. In particular, only the necessary regions for tolerance compensation, namely the joining regions between connecting surfaces of the frame elements opposing one another, are to be filled up using the joining element. The joining element can accordingly be used expediently and efficiently.

According to a concurrent aspect of the invention, a manhole covering having at least one first manhole cover and a frame system according to the invention is provided. The frame system according to the invention is usable in this meaning in particular with at least one corresponding manhole covering.

According to one embodiment, the at least one manhole cover can be fitted into the frame system by means of the filling of the at least one joining region with the joining element, wherein preferably two or more joints are provided and filled, however, in order to enable tolerance compensation which is adequate and as simple as possible between cover and frame elements.

Therefore, tolerances of both the frame elements and also the at least one manhole cover can be taken into consideration and adapted during the formation and filling of the joining regions with the joining element. An exact formation of the manhole covering is possible.

In particular, the frame system can be assembled, the at least one manhole cover can be inserted into the frame system and subsequently the at least one joining region can be filled up or filled by means of the joining element, wherein, in order to enable tolerance compensation which is adequate and as simple as possible between cover and frame elements, however, preferably two or more joints are filled. In this way, exact assembly of the manhole covering without play is possible.

The invention is explained in greater detail hereinafter on the basis of an exemplary embodiment with reference to the appended schematic drawings with further details.

Figure 1:
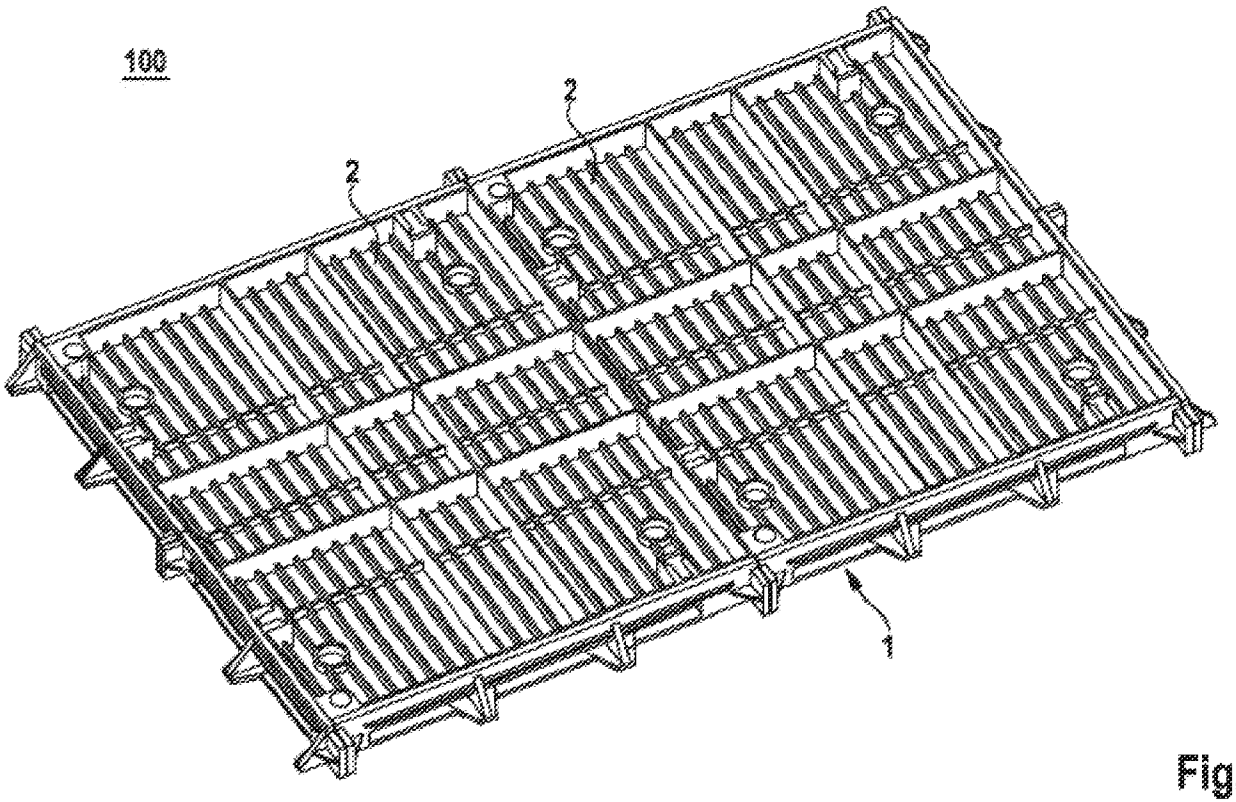
FIG. 1 shows a perspective view of a manhole covering according to the invention.
Figure 2:
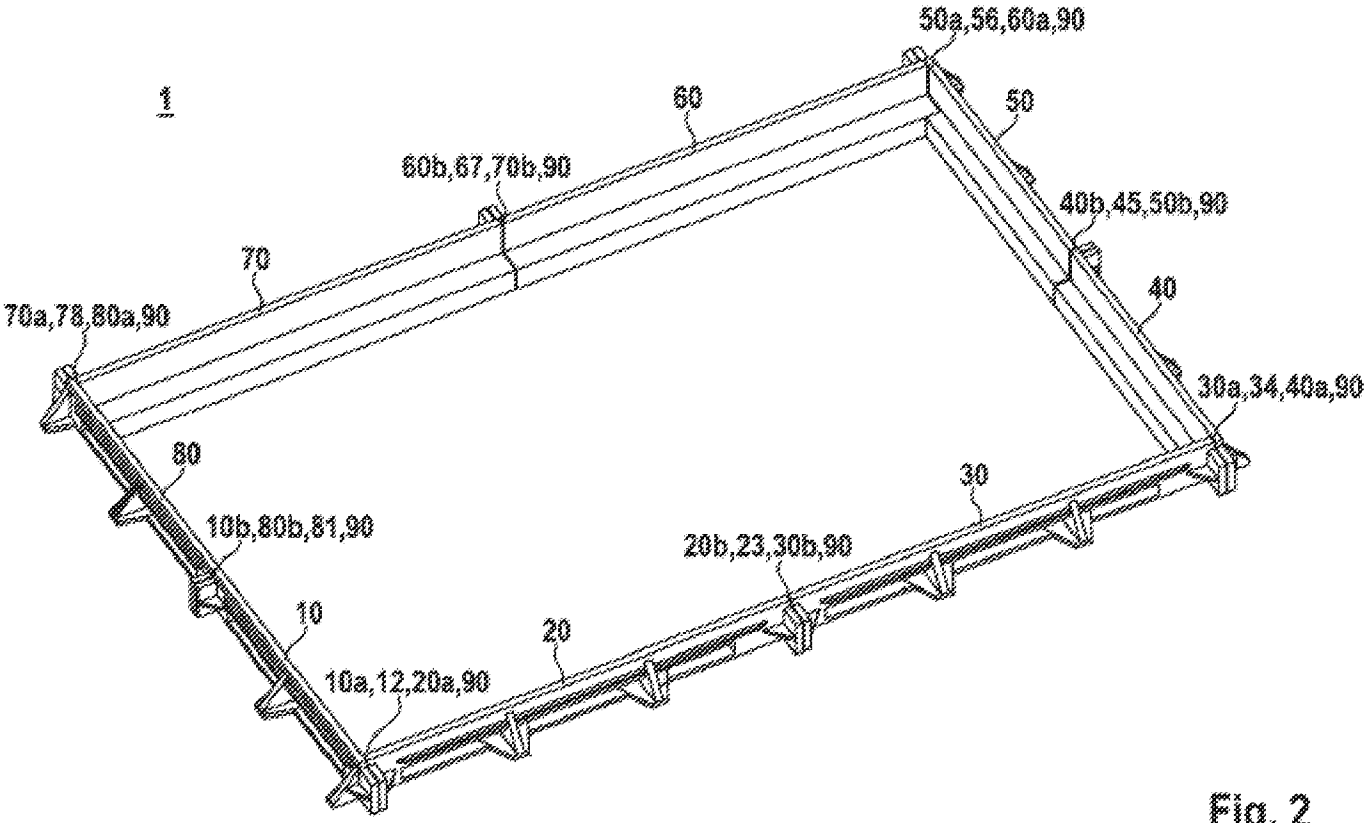
FIG. 2 shows a perspective view of a frame system according to the invention.

FIG. 1 shows a manhole covering 100 having a frame system 1 and two manhole covers 2. In contrast, FIG. 2 illustrates the frame system 1 according to FIG. 1, but without the manhole covers 2.

According to FIG. 1, the frame system 1 includes a total of eight frame elements 10; 20; . . . ; 80 having different lengths. Each of the frame elements 10; 20; . . . ; 80 is formed having a first connecting surface 10*a*; 20*a*; . . . ; 80*a*, in the form of a corner connecting surface, and a second connecting surface 10*b*; 20*b*; . . . ; 80*b*, in the form of a lateral connecting surface. Accordingly, each of the frame elements 10; 20; . . . ; 80 according to FIG. 1 adjoins a corner of the frame system 1 with its lateral end.

Between adjacently arranged frame elements 10; 20; . . . ; 80, the respective first connecting surfaces 10*a*; 20*a*; . . . ; 80*a* or second connecting surfaces 10*b*; 20*b*; . . . ; 80*b* opposite to one another form an individual joining region 12; 23; 34; 45; 56; 67; 78; 81. A joining region 12 is provided between the first and second frame element 10; 20, which can differ, for example, from the joining region 56 between the fifth and sixth frame element 50; 60.

Furthermore, a joining element 90 is provided in each of the joining regions 12; . . . ; 81, for the preferably complete filling of the respective joining region 12; . . . ; 81. Exact filling can thus be provided for each individual joining region 12; . . . ; 81 by means of the joining element 90, in particular by having the joining element 90 flow in or pouring it in a liquid physical state into the respective joining region 12; . . . ; 81.

In that the joining element 90 preferably includes a hot melt adhesive, in particular a co-polyamide, furthermore a nondestructive disassembly of the assembled manhole covering 100 or the frame system 1 and complete reproduction thereof can be provided. Inter alfa, simplified transport and reassembly can thus be provided at the usage location.

Figure 3:
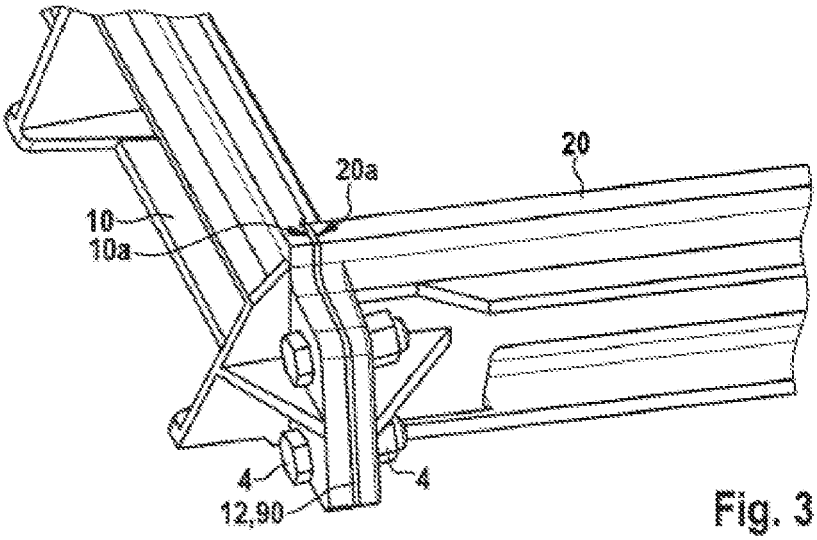
FIG. 3 shows a perspective enlarged view of a joined connection of a first frame element to a second frame element.

FIG. 3 shows a perspective enlarged view of a joined connection of the first frame element 10 to the second frame element 20.

It is apparent from FIG. 3 that the first and second frame element 10; 20 are connected to one another in a friction-locked and/or formfitting manner by means of two connecting elements 4 in the form of screw-nut connections. A connection of the frame elements 10; . . . ; 80 to provide a sufficiently stable frame system 1 for a manhole covering 100 is thus available.

In particular, the frame elements 10; . . . ; 80 can include corresponding through holes, in particular two through holes in each case according to FIG. 3, along the first and/or second connecting surfaces 10*a*; 10*b*; 20*a*; 20*b* . . . ; . . . 80*a*; 80*b*, for expediently receiving the connecting elements 4.

The first connecting surfaces or corner connecting surfaces 10*a*; 20*a* of the first and second frame element 10; 20 are oriented opposite to one another. A joining region 12 is formed between the first connecting surfaces 10*a*; 20*a* of the first and second frame element 10; 20. The joining region 12 is completely filled up using the joining element 90.

Figure 4:
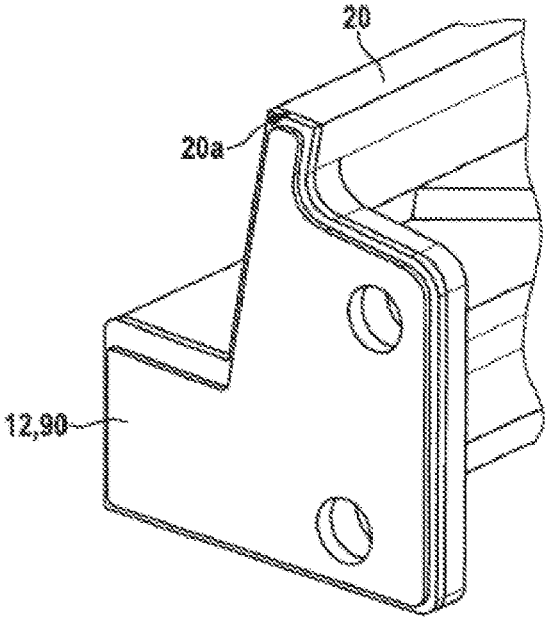
FIG. 4 shows a perspective sectional view of a connection of a first and a second frame element along first connecting surfaces.

FIG. 4 shows a perspective sectional view of the connection of the first to the second frame element 10; 20 along the first connecting surfaces or the corner connecting surfaces 10*a*; 20*a*. In this meaning, FIG. 4 shows the joining region 12 between the first and second frame element 10; 20, which is filled up using the joining element 90.

According to FIG. 4, the joining element 90 extends completely over the first connecting surfaces 10*a*; 20*a* after the filling or filling up of the joining region 12. In this meaning, the cast joining element 90 is to be understood in the meaning of a seal or the like, which images the contour of the first connecting surfaces 10*a*; 20*a* and thus completely fills up the joining region 12. Furthermore, two through holes along the first connecting surface 20*a* of the second frame element 20 can be seen, through which the connecting elements 4 extend, preferably during the casting using the joining element 90.

Figure 5:
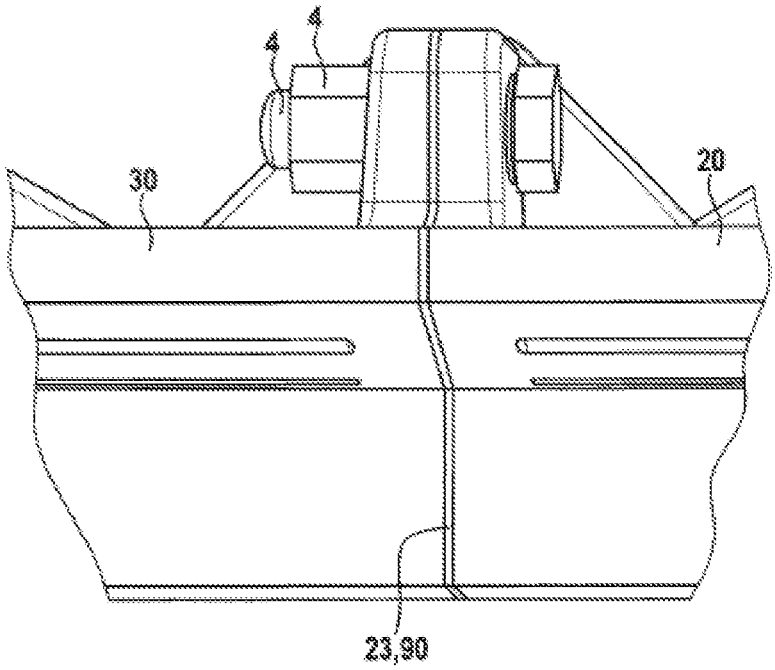
FIG. 5 shows a perspective detail of the joined connection of the second to a third frame element along second connecting surfaces.

FIG. 5 shows a perspective detail of the connection of the second to the third frame element 20; 30 along second connecting surfaces 20*b*; 30*b*.

The second and third frame element 20; 30 are also connected to one another in a friction-locked and/or form-fitting manner by means of preferably two connecting elements 4.

The second connecting surfaces 20*b*; 30*b* opposite to one another form the associated joining region 23 located in between. According to FIG. 5, the joining region 23 is completely filled up or filled using the joining element 90. One expedient embodiment of the joined connection is thus provided between the second and the third frame element 20; 30.

In summary, by means of the present invention, a frame system 1 which is advantageous to produce, can be transported, and can be disassembled and assembled multiple times is provided for a manhole covering 100, wherein tolerances of the individual components can be compensated for in such a way that an exact formation of the manhole covering 100 can be provided.

Each individual joining region 12; 23; . . . ; 81 can be filled individually here with the joining element 90 expediently and with very simple conditions, wherein furthermore nondestructive disassembly and a system reproducible completely in a functional aspect are provided.

It is to be noted at this point that all above-described parts are claimed as essential to the invention seen alone and in any combination, in particular the details illustrated in the drawing. Modifications thereof are routine for a person skilled in the art.

LIST OF REFERENCE SIGNS

1 frame system
2 manhole cover
4 connecting elements
10 (first) frame element
10*a* first (corner) connecting surface (of the first frame element)
10*b* second (lateral) connecting surface (of the first frame element)
12 joining region (between the first and the second frame element)
20 (second) frame element
20*a* first (corner) connecting surface (of the second frame element)
20*b* second (lateral) connecting surface (of the second frame element)
23 joining region (between the second and the third frame element)
30 (third) frame element
30*a* first (corner) connecting surface (of the third frame element)
30*b* second (lateral) connecting surface (of the third frame element)
34 joining region (between the third and the fourth frame element)
40 (fourth) frame element
40*a* first (corner) connecting surface (of the fourth frame element)
40*b* second (lateral) connecting surface (of the fourth frame element)
45 joining region (between the fourth and the fifth frame element)
50 (fifth) frame element
50*a* first (corner) connecting surface (of the fifth frame element)
50*b* second (lateral) connecting surface (of the fifth frame element)
56 joining region (between the fifth and the sixth frame element)
60 (sixth) frame element
60*a* first (corner) connecting surface (of the six.h frame element)
60*b* second (lateral) connecting surface (of the sixth frame element)
67 joining region (between the sixth and the seventh frame element)
70 (seventh) frame element
70*a* first (corner) connecting surface (of the seventh frame element)
70*b* second (lateral) connecting surface (of the seventh frame element)
78 joining region (between the seventh and the eighth frame element;
80 (eighth) frame element
80*a* first (corner) connecting surface (of the eighth frame element)
80*b* second (lateral) connecting surface (of the eighth frame element)
81 joining region (between the eighth and the first frame element)
90 joining element
100 manhole covering

The invention claimed is:

1. A frame system for a manhole covering comprising:

at least one first frame element and one second frame element, wherein the at least one first frame element and one second frame element include at least one first connecting surface and/or at least one second connecting surface, wherein the at least one first and one second frame element are connectable to one another in a friction-locked and/or formfitting manner along respective opposing at first and/or second connecting surfaces, wherein in a connected state of the at least one first and one second frame element, at least one joining region is formed between the respective opposing first and/or second connecting surfaces, the joining region being a tolerance compensation between the respective opposing first and/or second connecting surfaces, wherein a detachable joining element is provided in the at least one joining region in such a way that the connected state of the at least one first and one second frame elements is detachable and reproducible, the detachable joining element forms a gap between the respective opposing first and/or second connecting surfaces in the at least one joining region, and wherein the joining element comprises a hot melt adhesive.

2. The frame system as claimed in claim 1, wherein the at least one joining region can be caulked by means of the joining element, so that the joining element can be introduced into the at least one joining region in the connected state of the at least one first and one second frame elements.

3. The frame system as claimed in claim 1, wherein the hot melt adhesive comprises a co-polyamide.

4. The frame system as claimed in claim 1, wherein the frame system comprises at least four frame elements each comprising a first and/or a second connecting surface, wherein between the adjoining frame elements in each case at least one joining region is formed along respective opposing first and/or second connecting surfaces, and wherein in the connected state of the frame elements only the joining regions can each be filled using the joining element.

5. The frame system as claimed in claim 1, wherein the at least one first and one second frame elements are able to be disassembled non-destructively after filling the at least one joining region with the joining element.

6. The frame system as claimed in claim 1, wherein the at least one first connecting surface and/or at least one second connecting surface are entirely separated by the detachable joining element.

7. The frame system as claimed in claim 6, wherein the at least one joining region is filled exclusively with the detachable joining element.

8. The frame system as claimed in claim 1, wherein the at least one first connecting surface and at least one second connecting surface are not in contact with one another.

9. A manhole covering comprising at least one manhole cover and a frame system as claimed in claim 1.

10. The manhole covering as claimed in claim 9, wherein the manhole cover is fitted into the frame system by means of the filling of the at least one joining region using the joining element.

* * * * *